US009139406B2

(12) United States Patent
Rolland et al.

(10) Patent No.: US 9,139,406 B2
(45) Date of Patent: Sep. 22, 2015

(54) EQUIPMENT FOR HANDLING PACKS OF TIRES

(75) Inventors: Etienne Rolland, Martres sur Morge (FR); Philippe Petrault, Coumon d'Auvergne (FR); Bernard Defudes, Rochemaure (FR); Serge Lapierre, Bollene (FR); Sylvain Soboul, Viviers (FR); Damien Loussouarn, Laudun (FR)

(73) Assignees: Michelin Recherche et Technique S.A., Granges-Paccot (CH); COMPAGNIE GENERALE DES ETABLISSEMENTS MICHELIN, Clermont-Ferrand (FR)

( * ) Notice: Subject to any disclaimer, the term of this patent is extended or adjusted under 35 U.S.C. 154(b) by 1299 days.

(21) Appl. No.: 12/989,524

(22) PCT Filed: Apr. 24, 2009

(86) PCT No.: PCT/EP2009/054932

§ 371 (c)(1),
(2), (4) Date: Apr. 6, 2011

(87) PCT Pub. No.: WO2009/130295

PCT Pub. Date: Oct. 29, 2009

(65) Prior Publication Data

US 2011/0182707 A1 Jul. 28, 2011

(30) Foreign Application Priority Data

Apr. 25, 2008 (FR) ..... 08 52782

(51) Int. Cl.

| | |
|---|---|
| ***B66F 9/16*** | (2006.01) |
| ***B66F 9/18*** | (2006.01) |
| ***B66F 9/19*** | (2006.01) |

(52) U.S. Cl.
CPC ... *B66F 9/16* (2013.01); *B66F 9/18* (2013.01); *B66F 9/181* (2013.01); *B66F 9/195* (2013.01)

(58) Field of Classification Search
CPC ..... B62B 2202/31; B62B 2203/20; B62B 2203/30; B66F 9/06; B66F 9/12; B66F 9/16; B66F 9/18; B66F 9/181
USPC ..... 414/620, 622, 623, 624, 627, 642, 619; 280/79.4, 79.6
See application file for complete search history.

(56) References Cited

U.S. PATENT DOCUMENTS 3,081,892 A * 3/1963 Cook ..... 414/445
3,115,262 A * 12/1963 Avery ..... 414/622

(Continued)

FOREIGN PATENT DOCUMENTS

| | | |
|---|---|---|
| EP | 1 671 883 | 6/2006 |
| JP | 10 310 393 | 11/1998 |
| WO | WO 94/02406 | 2/1994 |

*Primary Examiner* — Saul Rodriguez
*Assistant Examiner* — Ashley Romano
(74) *Attorney, Agent, or Firm* — Cozen O'Connor

(57) ABSTRACT

A handling device intended to grasp and to carry a pack (k) formed by a stack of tires maintained in compression by a continuous, substantially airtight band covering the entire surface of the pack (k) and wound under tension around the pack (k) so as to constitute a unit of which the vertical faces are generally devoid of roughness and which can be grasped by the handling device, comprising an inclinable carriage (2) extended by at least two feet (21, 22) oriented toward the front of the inclinable carriage (2) and secured to the carriage (2), at the end of which feet is arranged an articulation of horizontal axis (BB') allowing the inclination of the carriage (2) from a substantially vertical position to an inclination forming a given angle (β) with the vertical direction, wherein the carriage (2) comprises a plurality of suction cups (20) intended to apply a vertical face of the pack of tires (k) against the front face of the inclinable carriage (2).

18 Claims, 8 Drawing Sheets

(56) References Cited

U.S. PATENT DOCUMENTS

Figure 1:
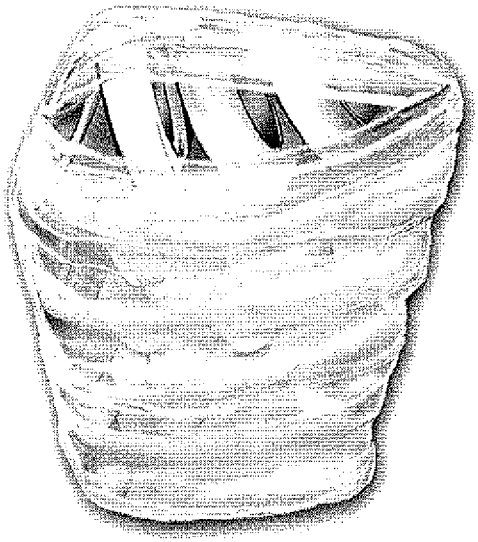

| | | | | |
|---|---|---|---|---|
| 3,207,348 | A * | 9/1965 | Olson | 414/627 |
| 3,361,280 | A | 1/1968 | Traver | |
| 3,384,255 | A * | 5/1968 | Hickman | 414/620 |
| 3,966,070 | A * | 6/1976 | Barth | 414/713 |
| 4,858,415 | A * | 8/1989 | Hake | 53/438 |
| 5,385,440 | A * | 1/1995 | Raben | 414/608 |
| 5,709,520 | A * | 1/1998 | Pish | 414/427 |
| 2002/0187030 | A1 * | 12/2002 | Boyanich | 414/490 |
| 2006/0182586 | A1 * | 8/2006 | Lauvdal | 414/623 |
| 2007/0063471 | A1 * | 3/2007 | Carlei | 280/79.7 |
| 2012/0119530 | A1 * | 5/2012 | Lauvdal | 294/188 |

* cited by examiner

EQUIPMENT FOR HANDLING PACKS OF TIRES

The invention relates to the field of handling, and more particularly to the field of handling tires intended for equipping passenger vehicles.

The incessant search for gains in productivity, twinned with a constant concern to improve the working conditions of the operators in the field of handling, has led the various players in the industrial sector concerned to optimize the logistics chain by acting on the storage conditions in industrial warehouses, on transport, on loading and unloading operations, and on the production of easily identifiable batches which can be moved according to the delivery requirements or to optimize the storage areas, while preserving the integrity of the tires.

A widely employed solution consists in using specially dimensioned pallets in order to be able to receive tires of varied dimensions and diameters. By way of example, a commonly used pallet in storage warehouses is described in application U.S. Pat. No. 5,259,325, in which the tires are stored in a stack or in a roll.

Pallets of this type have the advantage of constituting homogeneous batches of tires, of being able to be arranged on top of one another over large heights, of being able to be handled by mechanical means of the fork-lift truck type, and of offering good protection of the tires against external attack. By contrast, they are less adapted to transport, in particular over long journeys, by virtue of the low number of tires that they contain, and of the management involved in returning the empty pallets.

For transport over long distances, it will be sought to combine the greatest number of tires in a given volume, which may equally be a lorry trailer, a maritime container or else a railway carriage. A solution commonly used consists in arranging the tires on one another with a particular arrangement termed a "herringbone" arrangement or else a "chain" arrangement, and in placing the volume thus formed in compression so as to optimize the loading. This method is described, by way of example, in patent U.S. Pat. No. 5,092,106.

Although very effective for optimizing the volume to be loaded, the latter method nevertheless has the disadvantage of having to be partly implemented manually, which is a limiting factor in terms of costs, ergonomics, integrity of the batches or else warehousing.

Thus, methods of packaging tires have been proposed which, while reducing the space requirement, make it possible to manipulate compact batches.

A first method consists, for example, in producing stacks of tires, then in packing them in a plastic film in order to secure them, so as to constitute homogeneous batches which are easier to handle.

Another solution, described in publication FR 2 243 115 or else in publication EP 1 671 883 of the Applicant, consists in stacking the tires according to an arrangement termed a "herringbone" arrangement, then in compressing the batch, and in immobilizing it with the aid of a restraining means such as bands, ties, nets, packing cloths or else tension-resistant sheets, with the aim of maintaining the pack thus formed in its compressed state while opposing an elastic relaxation of the tires.

This method makes it possible to obtain autonomous packaging units which are sufficiently rigid and can be manipulated directly with the aid of a conventional fork-lift truck without it being necessary to arrange the batch on a pallet beforehand. The packaged pack has a structural rigidity such that it does not deform when it is grasped by its lower part by the two forks of a conventional fork-lift truck.

Publication EP 1 671 883 additionally proposes particular arrangements with the aim of allowing the insertion of the forks of a fork-lift truck directly below the load, by providing free spaces between the tires forming the first layer of the stack.

However, it has been proven in practice that these arrangements are not totally satisfactory in that they are detrimental to the rigidity of the pack on the one hand and that they weaken the tires arranged on the carrying region of the forks on the other hand.

The object of the invention is to propose a specific handling device which can be adapted to any type of lifting and transport means such as a conventional fork-lift truck. This handling device is particularly designed for the handling of packs of tires formed by a stack of tires maintained in compression by a continuous, substantially airtight band covering the entire surface of the pack and wound under tension around the said pack so as to form a vertical face generally devoid of roughnesses and constitute a unit which can be grasped by the said handling device.

This handling device comprises an inclinable carriage. This carriage is extended by at least two feet oriented towards the front of the carriage and secured to the carriage, and at the end of which feet is arranged an articulation allowing the inclination of the said carriage about a horizontal axis, from a substantially vertical position to an inclined position forming a given angle $\beta$ with the vertical direction.

This handling device is characterized in that the said carriage comprises a plurality of suction cups intended to apply the vertical face of the pack of tires against the front face of the carriage.

By front and rear are meant the position directed towards the front or the rear of the vehicle equipped with the handling device according to the invention.

This particular arrangement makes it possible to press the load formed by the pack of tires against the front face of the inclinable carriage. By inclining the carriage by an angle $\beta$, the load is forced to tilt about the end of the feet, with the result that the pack, through the lever effect caused by the feet, lifts slightly off the ground. The pack then rests on the suction cups and on the front surfaces of the feet, which surfaces are inclined by an angle $\alpha+\beta$ with respect to the vertical direction. The friction forces between the surface of the pack and the front surfaces of the feet, and also the pressing force exerted by the said application means on which a sheer force is exerted, are sufficient to retain the pack of tires in its position.

The invention also comprises the method which consists in using the handling device according to the invention and which comprises the steps in which:

- the inclinable carriage is arranged in a vertical position, and the said carriage is lowered until the feet are in contact with the ground,
- the carriage is advanced until it is in contact with the vertical face of the pack,
- a vacuum is applied inside the suction cups in order to press the rear face of the pack against the inclinable carriage,
- the carriage is inclined by a given angle $\beta$ so as to lift the pack slightly off the ground and to rest the pack on the carriage.

It is then arranged for the angle $\beta$ of inclination of the carriage supplemented by the angle $\alpha$ of the feet with respect to the vertical to be greater than 90° so as to prevent any movement of the load towards the front of the handling device.

Figure 2:
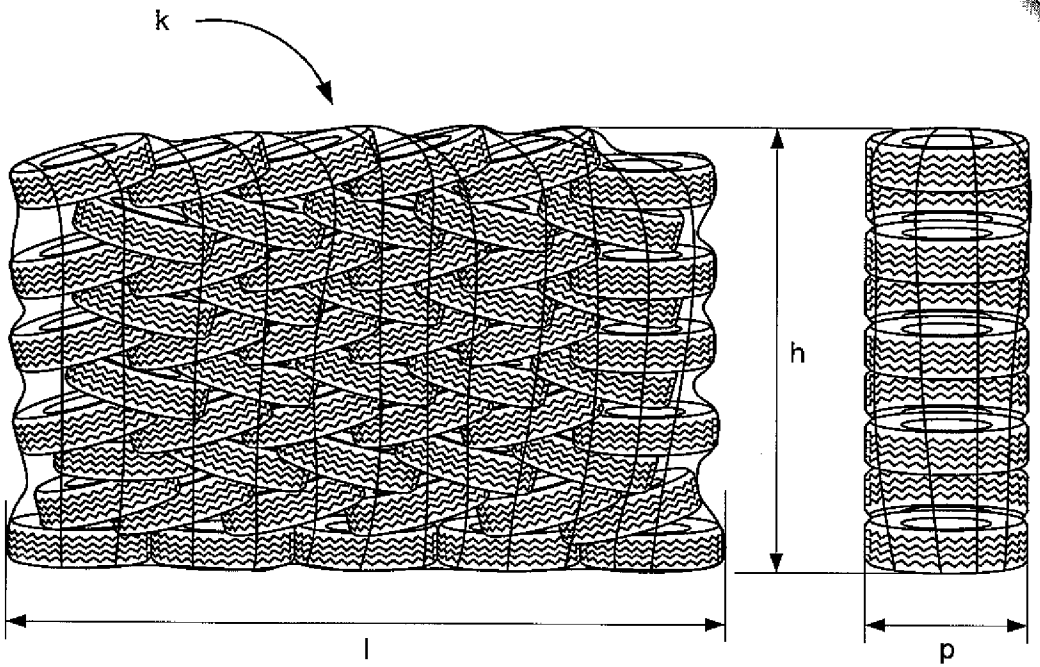
Figure 4:
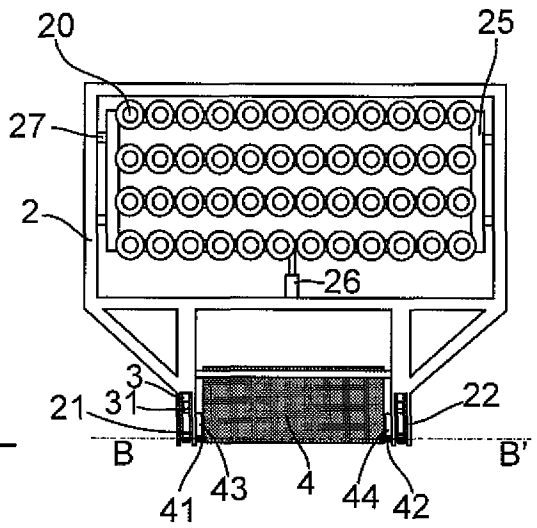
Figure 3:
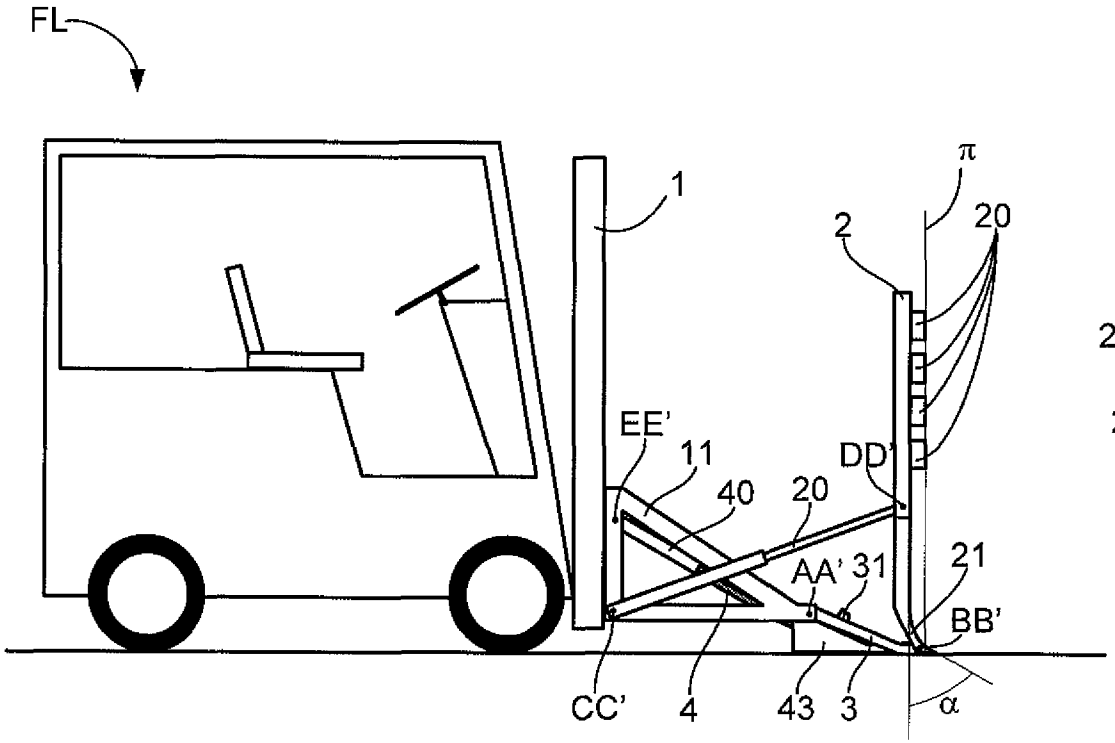

The description which follows is based on a preferred embodiment of the invention, and on FIGS. 1 to 10, in which:

FIG. 1 represents a perspective view of a pack of tires intended to be manipulated by a device according to the invention, FIG. 2 is a schematic front and profile view of the said pack of tires, FIG. 3 represents a schematic side view of a fork-lift truck equipped with a handling device according to the invention, FIG. 4 represents a front view of a handling device according to the invention, FIGS. 5 to 10 represent, in a schematic manner, the various steps of handling a pack of tires with the aid of a device according to the invention mounted on a conventional fork-lift truck.

FIGS. 1 and 2 represent a pack k of tires intended to be handled with the aid of a device according to the invention. The general characteristics of the pack are described in the table below and vary between minimum and maximum values as a function of the size of the tires that it is sought to package.

| | Minimum | Maximum |
|---|---|---|
| Number of tires | 20 | 80 |
| Mass in kg | 200 | 500 |
| Length (l) in mm | 2250 | 2380 |
| Width (p) in mm | 400 | 800 |
| Height (h) in mm | 740 | 1450 |

The bands serving to maintain the batch of tires in compression are formed from a weldable material, such as a stretchable high-density or low-density polyethylene film, abbreviated to LDPE or HDPE. The thickness of the band can vary from 20 to 80 μm, and its width can vary from 150 to 600 mm.

It is important that the band is resistant to tension to withstand the forces imposed by the tires in compression. Likewise, the compression force is adjusted such that the batch thus packaged can constitute a sufficiently rigid unit in order to be able to be manipulated with the aid of handling means such as that forming the subject of the present invention. Preferably, a band of slightly higher thickness will be chosen so as to avoid the deterioration of the bands by the suction cups during the handling of the pack with the aid of the said handling device.

It is also important that the pack has vertical surfaces generally devoid of roughness, and substantially airtight, such that the action of the suction cups can be exerted correctly.

The handling device illustrated by FIGS. 3 and 4 comprises an inclinable carriage 2 extended by at least two feet 21 and 22 secured to the carriage 2. The feet are oriented towards the front of the inclinable carriage 2 and form an angle α with the latter.

The number of feet is not limiting and must be determined as a function of the space requirement rules to be observed at the time of designing the device. However, for reasons of balancing the load, it is necessary to provide at least two feet.

Figure 7:
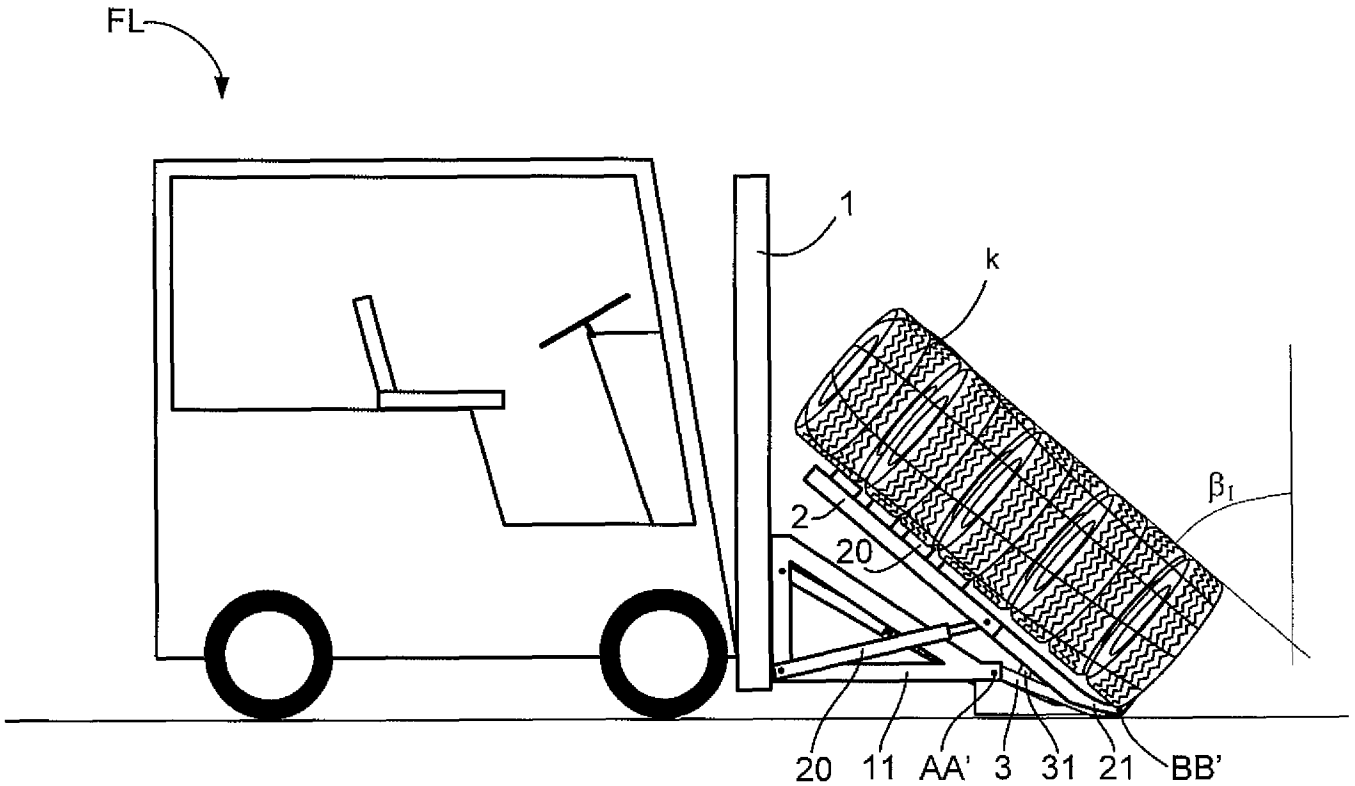

Each of the feet 21, 22 is mounted on a rigid support chassis 11 by means of a connecting rod 3. The two ends of each of the connecting rods 3 are connected to the chassis 11 by an articulation of horizontal axis AA' on the one hand, and to the end of a foot (21, 22) by the articulation of horizontal axis BB' on the other hand, such that the inclinable carriage 2 can tilt towards the rear, about the axis BB' or the axis AA', under the action of cylinders 20, from an angular position forming, with respect to the vertical direction, a zero angle as illustrated in FIG. 3, or even a slightly negative angle, to a position which is inclined towards the rear by an angle β with respect to the vertical direction, as is illustrated in FIG. 7 or in FIG. 8.

The cylinder 20 is connected to the chassis 11 via an articulation of horizontal axis EE' and to the carriage 2 via an articulation of horizontal axis DD'. For reasons of symmetry of the applied forces, the device as illustrated in the exemplary embodiment of the invention comprises two cylinders 20, arranged laterally one on each side of the chassis 11.

The value of the angle α can usefully be between 30° and 60°, and must be determined as a function of the maximum inclination β of the carriage, with the result that the sum of the angles α and β is greater than 90°. The angle α will be chosen so as to optimize the lever effect of the foot (21, 22) on the lower edge of the pack, during the tilting of the latter, but also so as to prevent the sliding of the pack when the latter rests on the front surfaces of the feet. Too low a value reduces the value of the threshold above which the pack starts to slide, but too high a value increases the punching effect of the foot in the tires forming the pack when the foot exerts its lever function. A value of the angle α between 20° and 45° seems to be a satisfactory compromise, taking account of the mean sliding coefficients observed between the surface of the pack (formed by the retaining bands) and the front surface of the feet (21, 22). By way of improvement, it is possible to coat the front surface of the feet with an anti-skid material.

The maximum value of the angle β is determined experimentally, and can usefully be between 45° and 70°. However, a higher value makes it possible to better stabilize the load on the chassis 11 when the fork-lift truck moves.

The support chassis 11 of the handling device illustrated in FIGS. 3 and 4 slides vertically on the mast of a fork-lift truck FL under the action of a raizing and lowering means (not shown). The simplified, but non-limiting, embodiment of the said chassis 11 is that of a triangle of which one of the sides is secured to the mast 11. The inclination of the upper side of the chassis with respect to the vertical direction substantially determines the maximum inclination angle β of the carriage on the support chassis 11.

Figure 9:
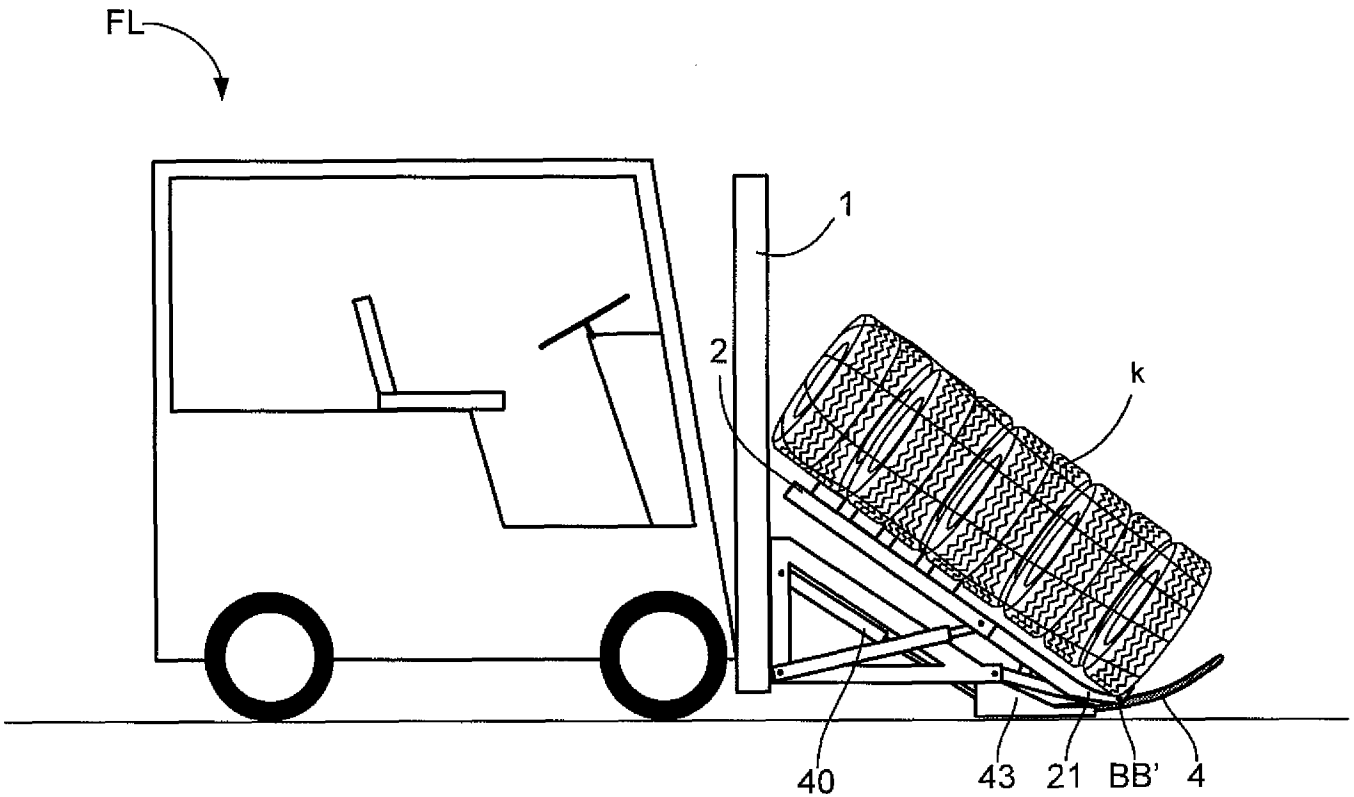

A retractable claw 4 of concave shape is arranged on the chassis 11. Under the action of a cylinder 40, the said retractable claw 4 deploys along a substantially curvilinear path, from a retracted position, as is illustrated in FIG. 3, to an advanced position in which the said retractable claw 4 extends below all or part of the width p of the tire pack, so as to increase the securing of the load, as is illustrated in FIG. 9. The cylinder 40 is connected to the chassis 11 via an articulated connection of horizontal axis EE', and to the retractable claw 4 by another articulated connection of horizontal axis (not shown).

In order to facilitate its deployment, the retractable claw 4 is equipped with lateral guides 41, 42, sliding in slideways 43, 44 arranged on the lateral faces of the chassis 11.

Figure 8:
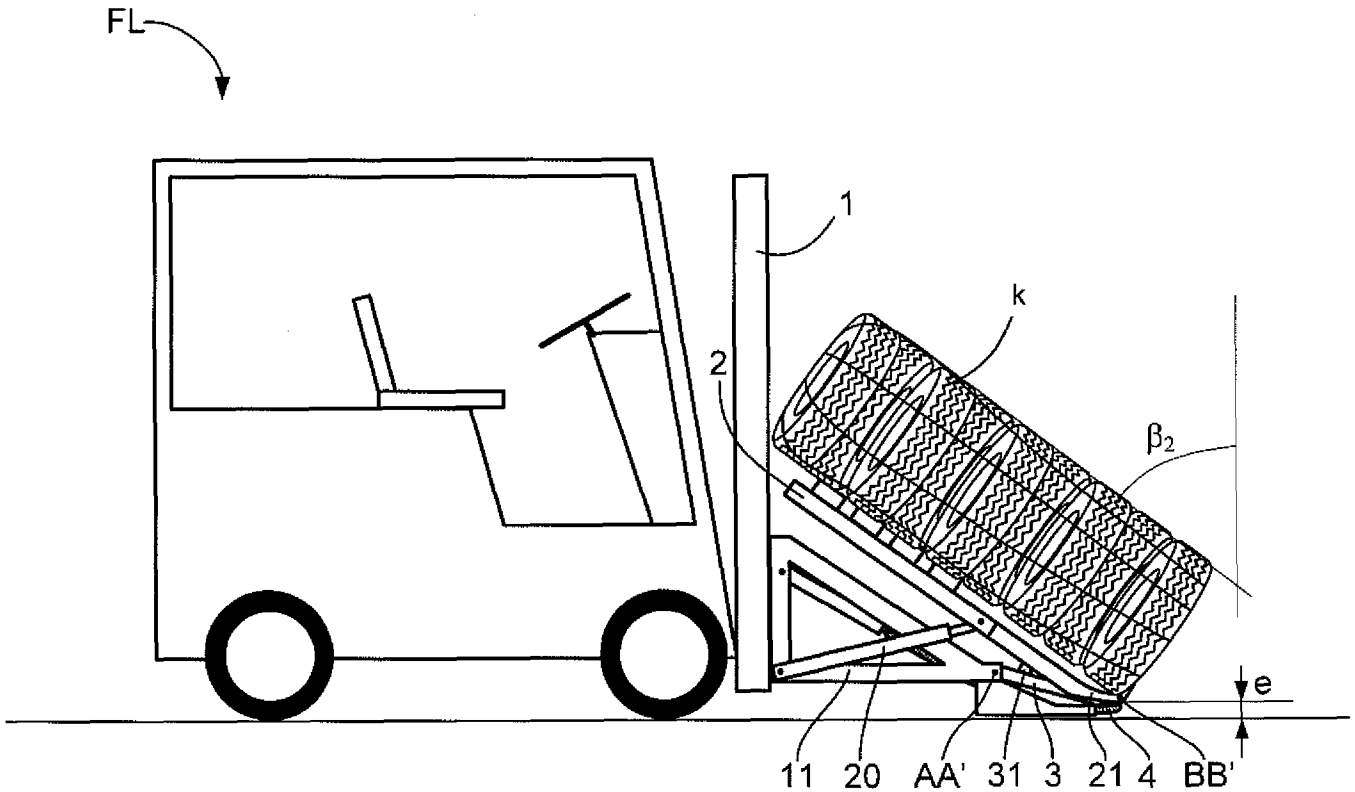

In a first step, under the action of the cylinder 20, the inclinable carriage 2 pivots by an angle $\beta_1$ about the axis BB' until it comes to bear against a stop 31 arranged on the connecting rod 3. By continuing the action of the cylinder 20, the assembly formed by the carriage and the connecting rod 3 pivots in a second step about the axis AA' until coming to the limit of its travel and forming an angle $\beta_2$ with the vertical direction, as is illustrated by FIGS. 7 and 8. The advantage of this additional angular movement is to clear the space between the ground and the lower part of the foot by a height e, such that the retractable claw 4 can deploy freely without risk of striking the lower part of the pack k. The height e is of the order of about ten centimetres.

The suction cups 20 are arranged on the front face of the inclinable carriage 2. These suction cups are connected to a vacuum source (not depicted). The suction cups are mounted on a frame 25. The frame 25 is mounted on a set of bearings 27 so as to be movable vertically with respect to the inclinable carriage 2 under the action of a cylinder 26. This particular arrangement has the advantage of allowing a height adjustment of the suction cups 28 as a function of the height h of the pack to be handled. Moreover, by regulating the pressure in the cylinder 26, using for example a gas cylinder, it is possible to impart a certain degree of flexibility in the vertical direction to the movable frame bearing the suction cups, so as to damp the shear forces exerted by the load on the suction cups with the aim of preventing the pack of tires from being released in the event of a sudden manoeuvre.

The number of suction cups must be adapted to the surface and to the weight of the load to be manipulated. In practice, when the surface to be grasped has a few irregularities, it is judicious to provide a large number of suction cups so as to overcome the case in which one or more suction cups have a poor vacuum engagement on the surface of the pack.

For the same reasons as above, it may prove useful to make the suction cups deformable in a direction perpendicular to the plane of the inclinable carriage 2, with the result that the application of the said suction cups to the rear face of the pack of tires does not suffer from the slight surface irregularities of the said face which are associated with the shape and the particular arrangement of the tires which make up the pack.

Preferably, it is arranged for the articulations of axis BB' to be situated in the same plane $\pi$ as the front faces of the suction cups 20 so as to facilitate the docking of the carriage 2 with respect to the load k to be grasped.

FIGS. 5 to 10 illustrate the various steps of installing the pack of tires on a fork-lift truck FL equipped with a handling device according to the invention.

Figure 5:
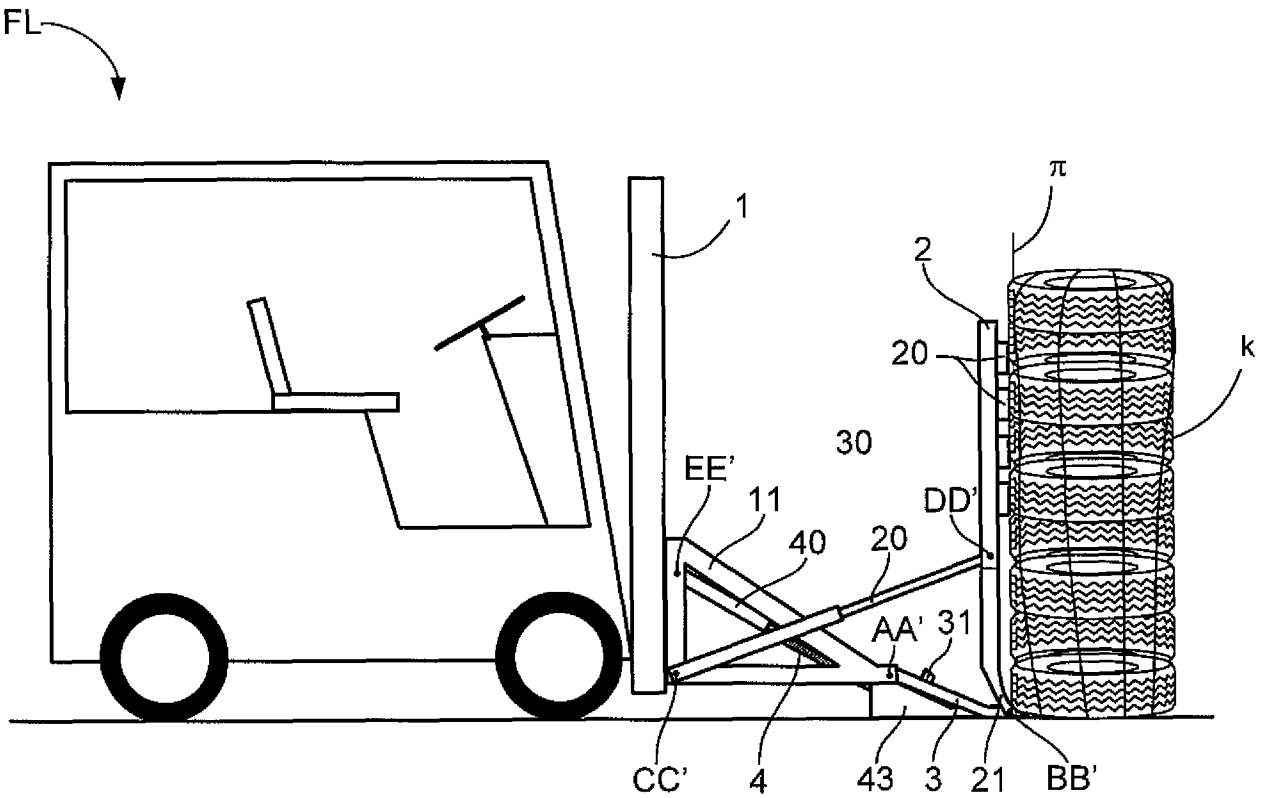

In a first stage, illustrated in FIG. 5, the inclinable carriage 2 is lowered until the feet 21, 22 are in contact with the ground, then the inclinable carriage 2 is placed in a vertical position. The fork-lift truck is moved towards the pack k until the suction cups 20 come into contact with the rear face of the said pack.

Figure 6:
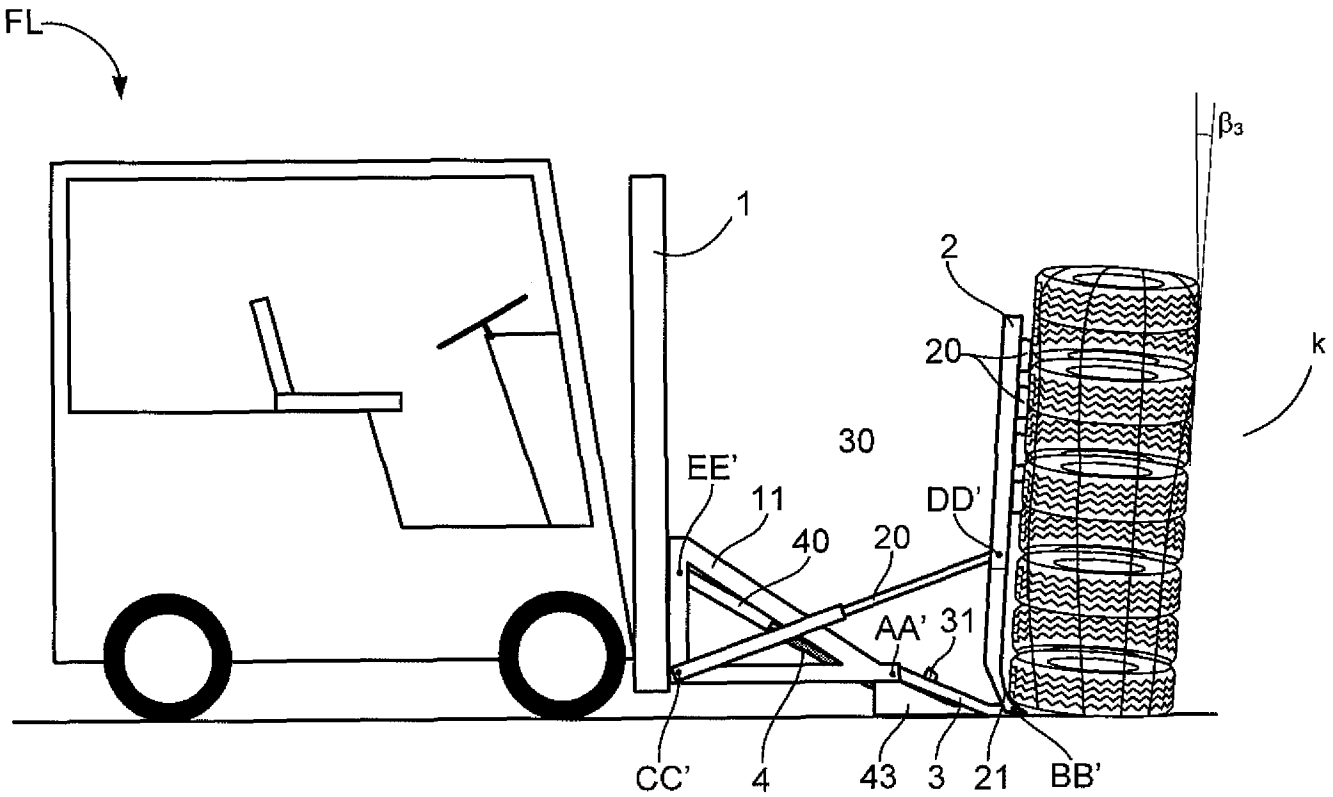

The feet 21, 22 also come into contact with the lower edge of the pack. In order to facilitate the placing of the feet against the said lower edge, it is possible to tilt the carriage about the articulation of axis BB' by an angle $\beta_3$, which is slightly negative, by actuating the cylinder 20 as is illustrated in FIG. 6. In practice, good results are obtained for an angle $\beta_3$ having a value of about −10° with respect to the vertical direction.

The following operation consists in applying a vacuum inside the suction cups so as to press the rear face of the pack of tires k against the inclinable carriage 2.

FIG. 7 illustrates the stage during which, under the action of the cylinder 20, the carriage 2 is inclined about the articulation of axis BB'. The pack k pivots about the end of the feet 21 and 22, which serve as a lever for lifting the load off the ground.

The pack k is then maintained by the suction cups and rests on the front face of the feet 21 and 22. It is possible to appreciate, at this stage, the need to choose a material forming the band maintaining the pack in compression that is sufficiently strong to withstand the shear forces imposed by the weight of the pack on the suction cups which adhere to the said band.

FIG. 7 illustrates the tilting movement of the carriage 2 under the action of the cylinder 20 until the load is inclined with respect to the vertical direction by an angle $\beta_1$. FIG. 8 illustrates the additional tilting to the angle $\beta_2$, during which the space between the ground and the feet 21 and 22 is freed. The freeing of this space allows the retractable claw 4 to be extended under the action of the cylinder 40, as is illustrated in FIG. 9. The pack is then firmly maintained by the feet 21 and 22, which make an angle above 90° with the vertical direction, and by the retractable claw 4. In this configuration, it would be conceivable, to save energy, to relax the vacuum inside the suction cups 20.

Figure 10:
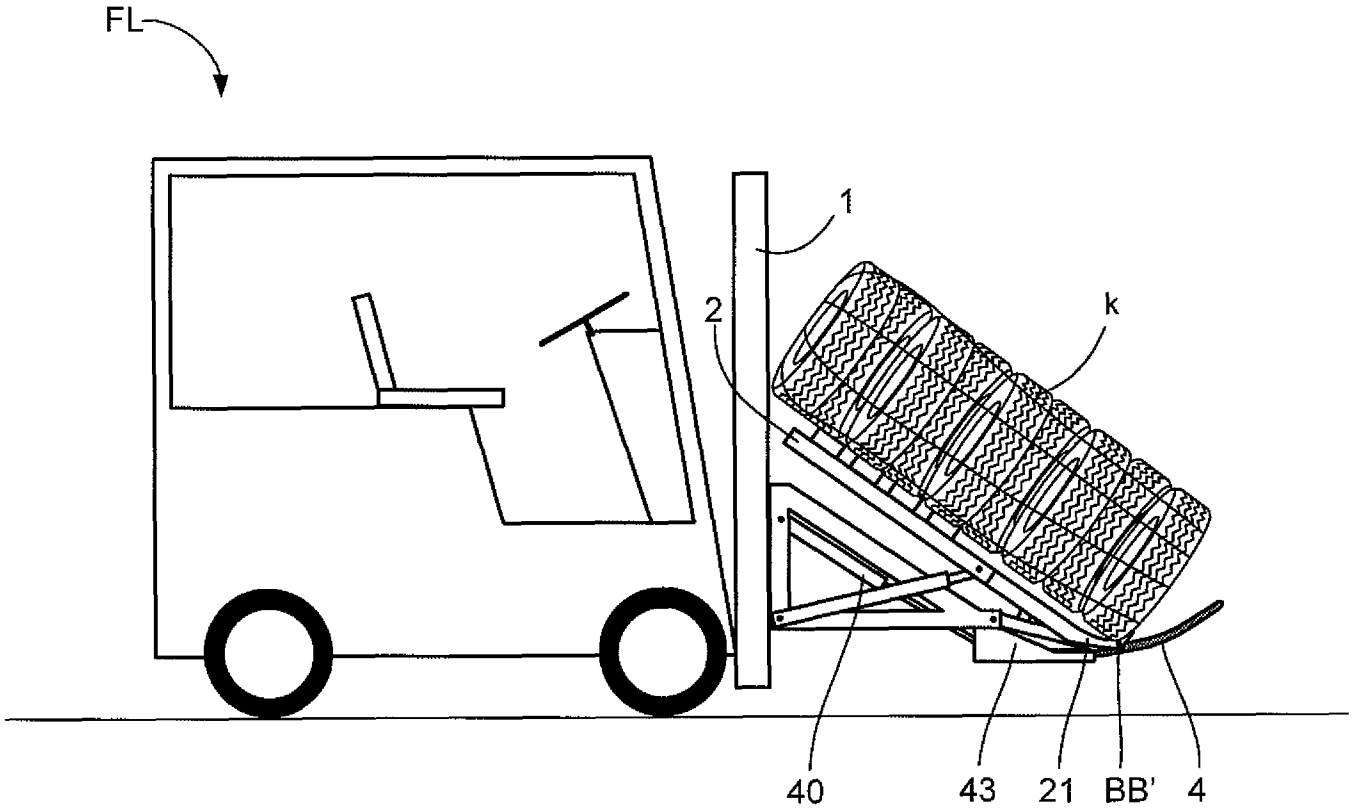

Before making a movement, the chassis 11 is raised along the telescopic mast 1, as is illustrated in FIG. 10.

The unloading operation consists in carrying out the operations described above in the reverse order, namely:

- lowering the movable carriage of the telescopic mast 1 so as to place the lower part of the feet 21, 22 in contact with the ground,
- actuating the cylinder 40 in order to retract the retractable claw 4,
- actuating the cylinder 20 in order to place the inclinable carriage 2 in a vertical position,
- relaxing the vacuum in the suction cups 20 so as to release the load k.

The number of tires making up the pack is relatively variable, but it is generally arranged for its dimensions to be adapted to the loading of a lorry or of the container in which the transport is carried out. To this end, provision can be made to place two packs on one another and to arrange as many rows thus constituted over the whole length of a trailer or of a standard container in order to best occupy the interior space. It will then be observed that the device according to the invention is particularly well suited to carrying out these loading or unloading operations in a reduced space. Specifically, it is not necessary to provide particular clearance spaces on each side of the lateral or upper faces of the load and it is therefore possible to introduce the pack into a means of transport or a packaging means of which the width and height are approximately multiples of the width and height of the pack.

The handling device as described in the preceding paragraphs makes it possible to move the packs of tires maintained in compression by a band. It is obvious that this preferred embodiment of the invention in no way prejudices alternative embodiments featuring the particular arrangements set forth in the foregoing paragraphs. In particular, equivalent principles can be adopted for handling loads having a sufficiently smooth face in order to be maintained by a system of suction cups. The size and the number of suction cups, the shape of the foot, and the angles of inclination can be adapted, without departing from the spirit of the invention, to the dimensions and to the general shape of the objects to be manipulated.

The invention claimed is:

1. A handling device for grasping and carrying a pack formed by a stack of tires maintained in compression by a continuous, substantially airtight band covering an entire surface of the pack and wound under tension around the pack so as to constitute a unit, vertical faces of the pack being substantially devoid of roughness, comprising:

- an inclinable carriage comprising a front surface and a plurality of feet, a first end of each foot extending from a bottom of the front surface, a second end of each foot extending downward and forward from the bottom of the front surface;
- a support chassis;
- a first articulation joint connecting the plurality of feet to the support chassis at the second end of each of the plurality of feet and configured so that the inclinable carriage and the plurality of feet are capable of articulating at the first articulation joint about a first horizontal articulation axis to incline the inclinable carriage from a substantially vertical position to a first inclination with a top of the front surface inclined backward; and a plurality of suction cups mounted to the front surface of the inclinable carriage capable of applying a suction force and of discontinuing application of the suction force, the plurality of suction cups positioned and suitable for contacting a portion of the surface of the pack, then grasping and carrying the pack when the suction force is applied by the suction cups.

2. The handling device of claim 1, wherein the feet extend forward from the bottom of the front surface at an angle of between 20° and 45° relative to the front surface of the inclinable carriage.

3. The handling device of claim 1, wherein the support chassis comprises:

a plurality of connecting rods connected at first ends thereof to the first articulation joint;

a second articulation joint at second ends of the plurality of connecting rods configured so that the plurality of connecting rods are capable of articulating at the second articulation joint about a second horizontal articulation axis parallel to the first horizontal articulation axis.

4. The handling device of claim 1, further comprising a retractable claw able to move between the feet along a substantially curvilinear path, from a retracted position to an extended position in which said retractable claw extends below all or part of a width of the pack when the pack has been grasped by the handling device.

5. The handling device of claim 4, wherein said retractable claw has an upward concave shape.

6. The handling device of claim 1, wherein the inclinable carriage further comprises a movable frame and wherein the suction cups are mounted on the movable frame, the movable frame being mounted so as to be capable of moving vertically in a plane parallel to the front surface of the inclinable carriage.

7. The handling device of claim 1, wherein said suction cups are deformable in a direction perpendicular to a plane formed by the front surface of the inclinable carriage such that the suction cups are capable of adapting to irregularities of the surface of the pack.

8. The handling device of claim 1, wherein the first horizontal articulation axis is substantially in a plane containing front surfaces of the suction cups.

9. The handling device of claim 1, wherein a maximum angle of the first inclination of the inclinable carriage is between 45° and 70°.

10. The handling device of claim 1, wherein a front face of the feet is coated with an anti-skid material.

11. A fork-lift truck having a telescopic mast equipped with the handling device of claim 1.

12. The handling device of claim 1, wherein the first articulation joint permits the inclinable carriage and the plurality of feet to articulate about the first horizontal articulation axis to incline the inclinable carriage from the substantially vertical position to a second inclination with the top of the front surface inclined forward.

13. The handling device of claim 12, wherein a maximum angle of the second inclination of the inclinable carriage is 10°.

14. The handling device of claim 12, wherein the feet extend forward from the bottom of the front surface at an angle of between 20° and 45° relative to the front surface of the inclinable carriage.

15. A method of handling a pack formed by a stack of tires maintained in compression by a continuous, substantially airtight band covering the entire surface of the pack and wound under tension around the pack so as to constitute a unit, vertical faces of the pack being substantially devoid of roughness, the method using a handling device comprising:

an inclinable carriage comprising a front surface and a plurality of feet, a first end of each foot extending from a bottom of the front surface, a second end of each foot extending downward and forward from the bottom of the front surface;

a support chassis;

a first articulation joint connecting the plurality of feet to the support chassis at the second end of each of the plurality of feet and configured so that the inclinable carriage and the plurality of feet to articulate at the first articulation joint about a first horizontal articulation axis to incline the inclinable carriage from a substantially vertical position to a first inclination with a top of the front surface inclined backward; and a plurality of suction cups mounted to the front surface of the inclinable carriage capable of applying a suction force and of discontinuing application of the suction force, the plurality of suction cups positioned and suitable for contacting a portion of the surface of the pack, then grasping and carrying the pack when the suction force is applied by the suction cups, the method comprising the steps of, in sequence:

arranging the inclinable carriage of the handling device in a vertical position, and lowering the inclinable carriage until the feet are in contact with a horizontal supporting surface on which the pack stands;

advancing the inclinable carriage until the suction cups are in contact with a portion of the surface of the pack;

applying a suction inside the suction cups in order to press the pack against the inclinable carriage; and tilting the inclinable carriage to the first inclination to lift the pack off the horizontal supporting surface.

16. The method of claim 15, wherein the handling device further comprises a retractable claw able to move between the feet along a substantially curvilinear path, from a retracted position to an extended position in which said retractable claw extends below all or part of a width of the pack when the pack has been grasped by the handling device, the method further comprising, after tilting the inclinable carriage to the first inclination to lift the pack off the horizontal supporting surface, moving the retractable claw from the retracted position to the extended position.

17. The method of claim 15, wherein the first articulation joint permits the inclinable carriage and the plurality of feet to articulate about the first horizontal articulation axis to incline the inclinable carriage from the substantially vertical position to a second inclination with the top of the front surface inclined forward, the method further comprising, after the advancing step and prior to the applying step, tilting the inclinable carriage to the second inclination to tilt a top of the pack forward.

18. The method of claim 17, wherein the handling device further comprises a retractable claw able to move between the feet along a substantially curvilinear path, from a retracted position to an extended position in which said retractable claw extends below all or part of a width of the pack when the pack has been grasped by the handling device, the method further comprising, after tilting the inclinable carriage to the first inclination to lift the pack off the horizontal supporting surface, moving the retractable claw from the retracted position to the extended position.

* * * * *